United States Patent [19]

Lawson

[11] Patent Number: 4,550,782

[45] Date of Patent: Nov. 5, 1985

[54] METHOD AND APPARATUS FOR INDEPENDENT SUPPORT OF WELL PIPE HANGERS

[75] Inventor: John E. Lawson, Houston, Tex.

[73] Assignee: Armco Inc., Middletown, Ohio

[21] Appl. No.: 446,995

[22] Filed: Dec. 6, 1982

[51] Int. Cl.[4] ..... F16L 21/00; E21B 19/10

[52] U.S. Cl. ..... 166/382; 166/88; 285/140; 285/141

[58] Field of Search ..... 166/88, 89, 382, 87; 285/140, 141, 142, 143

[56] References Cited

U.S. PATENT DOCUMENTS 2,035,834 3/1936 Penick ..... 166/89 X 4,295,665 10/1981 Pierce ..... 285/141 X

FOREIGN PATENT DOCUMENTS 235781 6/1960 Australia ..... 166/88

*Primary Examiner*—Stephen J. Novosad

*Assistant Examiner*—Bruce M. Kisliuk

*Attorney, Agent, or Firm*—Roylance, Abrams, Berdo & Goodman

[57] ABSTRACT

In well installations subjected to high internal fluid pressures, hangers for long casing strings are supported independently in the upright bore of a wellhead body or other support member without requiring that the hangers be stacked one atop another or that the bore diameter be stepped to provide an upwardly exposed shoulder for each hanger. All hangers save the lowermost hanger are supported by an annular support member engaged in a groove in the wellhead body, with no load being transferred from an upper hanger to a lower hanger.

14 Claims, 13 Drawing Figures

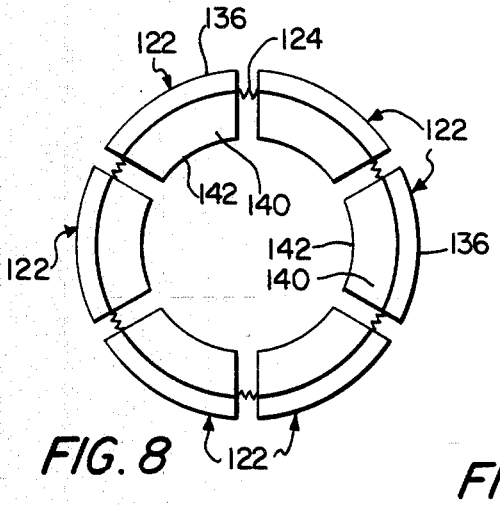
FIG. 8
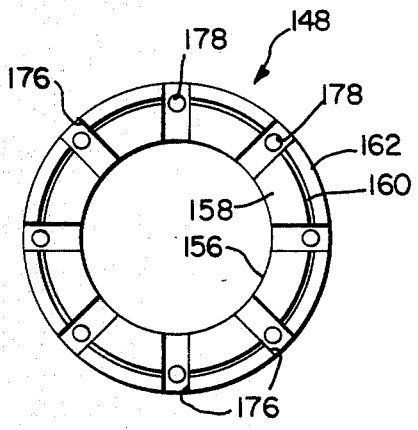
FIG. 9
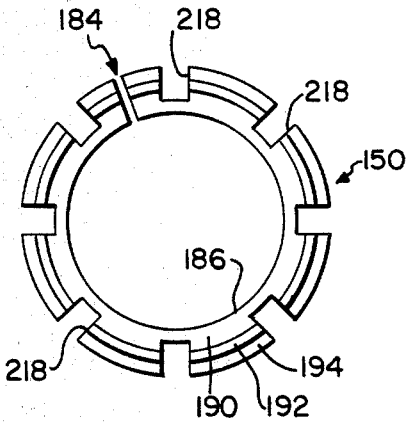
FIG. 10
FIG. 11
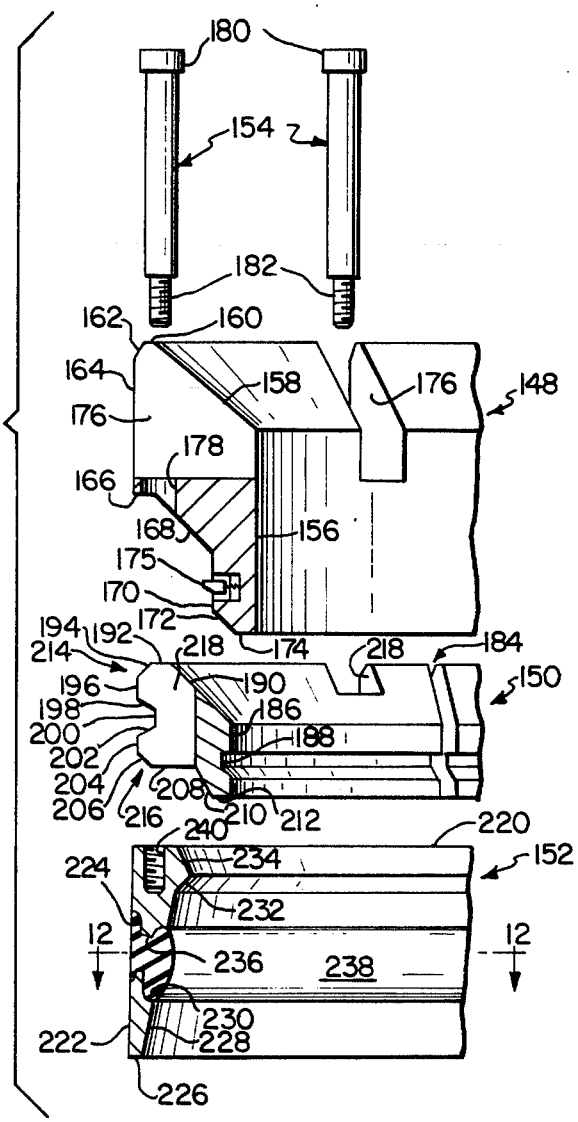
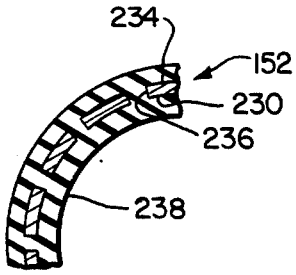
FIG. 12

METHOD AND APPARATUS FOR INDEPENDENT SUPPORT OF WELL PIPE HANGERS

The invention provides a method and apparatus for supporting a plurality of pipes, at least one of which is a casing string, in a well in such fashion that each pipe is supported independently from a support member such as a wellhead member.

RELATED APPLICATIONS

Subject matter disclosed herein is also disclosed and claimed in co-pending applications Ser. No. 316,397, filed Oct. 29, 1981, by Edward M. Galle, Jr., now U.S. Patent No. 4,460,042, issued July 17, 1984, and Ser. No. 446,994, filed Dec. 6, 1982, by John E. Lawson.

BACKGROUND OF THE INVENTION

Oil, gas and geothermal wells typically require that at least two strings of pipe, at least one of which is a casing string, be hung from a single support member, such as a wellhead member, and this is conventionally accomplished by securing a pipe hanger to the last joint of the string and landing the hanger in the support member. In some cases, the hanger for the outermost string is landed on a shoulder in the through bore of the support member and the hangers for the remaining strings are supported in series by the first-landed hanger, as seen for example in U.S. Pat. Nos. 3,268,243 issued Aug. 23, 1966, to W. W. Word, and 3,105,552, issued Oct. 1, 1963, to J. A. Haeber et al. While such practices are satisfactory for relatively shallow wells, they are not truly suitable for very deep wells where the loads applied by the pipe strings are so large that it is not desirable to support the aggregate load of all of the strings on a single shoulder. Some prior-art workers have therefore provided wellheads in which the through bore has one shoulder for each pipe hanger, the bore therefore being of stepped diameter as seen, for example, in U.S. Pat. No. 3,084,745, issued Apr. 9, 1963, to J. F. Floyd. Particularly for deep underwater wells, that practice is frequently not acceptable because the annular space available is not adequate to allow a stepped diameter through bore in the wellhead or like support member. Accordingly, there has been a continuing need for a method and apparatus which would make it practical to install each of several pipe hangers on its own support within the through bore of a wellhead body or like support member when the through bore is of constant diameter, in such fashion that each hanger transfers the load of its pipe string directly to the support member with substantially none of the load being transferred to the subadjacent pipe hanger.

In earlier times, when the weights of pipe strings were far less than today and when wells were established on land, so that the wellhead was immediately available to the human operators, prior-art workers proposed having each pipe hanger supported independently on the wellhead body by equipping the hanger with outwardly urged segments or dogs, the hanger simply being lowered until the segments or dogs reached a desired groove, whereupon the segments or dogs snapped outwardly to engage in that groove, with the hanger then being supported on the lower wall of the groove, as shown for example in U.S. Pat. No. 2,035,834, issued Mar. 31, 1936, to A. J. Penick et al. Though such approaches were practical for installations in which the wellhead or other support member was available to view and for direct manipulation of the equipment, they were not adopted for underwater installations in which the load of the pipe string was very large and the annular space available in the support member was small. For such applications, prior-art workers went to relatively complex structures such as those seen in U.S. Pat. Nos. 3,086,590, issued Apr. 23, 1963, to J. G. Jackson et al; 3,090,438, issued May 21, 1963, to G. M. Raulins; and 3,099,317, issued July 30, 1963, to W. L. Todd. There has accordingly been a continuing need for simplification and improvement of such pipe hanging methods and apparatus.

SUMMARY OF THE INVENTION

Method and apparatus embodiments of the invention require a support member, such as a wellhead body member, having an upright through bore, a generally upwardly facing lower support such as a transverse annular shoulder for support of the lowermost pipe hanger, and at least one transverse annular groove in a portion of the through bore which is above the lower support and is of substantially uniform diameter.

According to the method, a first pipe hanger, with a pipe string depending therefrom, is lowered through the through bore and landed on the lower support. There is then lowered into the through bore an annular support device comprising an annular load-bearing member which is resiliently expansible and contractible between a relaxed position of smaller diameter and an expanded position of larger diameter, the load-bearing member occupying its relaxed position while the annular support device is lowered in the through bore, the annular support device also having an upwardly directed frustoconical camming surface which tapers downwardly and inwardly and is so arranged that a downwardly acting force applied to the camming surface is effective to force the load-bearing member to its expanded position. As the annular support device is lowered within the through bore, the first pipe hanger is sensed as a reference point relative to the location of the transverse annular groove thereabove, and the support device is then stopped with the load-bearing member aligned generally with the groove. A downwardly acting force is then applied to the camming surface of the support device to force the load-bearing member outwardly to its expanded position, so that the load-bearing member is engaged in the groove so as to be capable of supporting a second pipe hanger on the load-bearing shoulder constituted by the lower wall of the groove. Advantageously, the load-bearing member of the support device is a resilient metal split ring having an upwardly exposed frustoconical camming surface and the support device also includes, above the split ring, an actuating ring having both a downwardly directed frustoconical camming surface and an upwardly directed shoulder, the camming surface of the actuating ring being in flush engagement with the camming surface of the split ring, and the actuating ring being arranged for releasable attachment to a handling tool by which the annular support device is lowered. Then, when sensing of the first pipe hanger indicates that the support device is in proper position, with its load-bearing member opposite the groove in which it is to be engaged, the downward force necessary to cause the camming surfaces to expand the split ring into engagement with the groove is applied by the handling tool. Advantageously, the actuating ring has a dependent inner extension, and the step of applying the downward force moves the extension telescopically into the load-bearing member so that the load-bearing member is held in its expanded position, engaged in the groove, by the extension after the handling tool is detached and recovered.

One advantageous way to sense the first pipe hanger is to hang the seal or pack-off device for the first pipe hanger from the support device via a lost-motion connection so that, as the support device is lowered through the bore of the support member, the pack-off device comes into at least preliminary engagement with the first pipe hanger. At that point, the load-bearing member of the support device can be in a position just above precise alignment with the groove, so that a small additional downward movement, such as that which may be required for preliminary or complete energization of the pack-off device, brings the load-bearing member into precise alignment with the groove. The load-bearing member is now stopped by the pack-off device and further downward travel of the handling tool applies to the load-bearing member the downward force necessary to expand that member.

OBJECTS OF THE INVENTION

It is accordingly a general object of the invention to support a plurality of strings of well pipe independently from a wellhead body or other support member having an upright through bore by pipe hangers disposed one above the other in the through bore without requiring that the through bore be of stepped diameter to provide a support shoulder for each hanger.

Another object is to provide a method and apparatus making it possible to install a pipe hanger on a support presented by a wall of a groove in the bore wall of a wellhead member or like support member by remote operations without use of unduly complex equipment and with improved ability to locate the hanger support in the support member.

A further object is to provide for simultaneous remote installation of both the pack-off for a lower pipe hanger and a support for the superadjacent hanger.

IDENTIFICATION OF THE DRAWINGS

Referring now to the accompanying drawings which form a part of this original disclosure:

FIG. 8 is a top plan view of an annular load-bearing support device carried by the first casing hanger;

FIG. 9 is a top plan view of an actuating ring forming part of a support and pack-off unit;

FIG. 10 is a top plan view of a split support ring forming the load-bearing member of the support and pack-off unit, FIGS. 8–10 being on smaller scale than FIGS. 1–6;

FIG. 11 is an enlarged, exploded, fragmentary longitudinal sectional view of the support and pack-off unit;

FIG. 12 is a fragmentary transverse sectional view taken generally on line 12—12, FIG. 11.

DETAILED DESCRIPTION OF THE INVENTION

Figure 1:
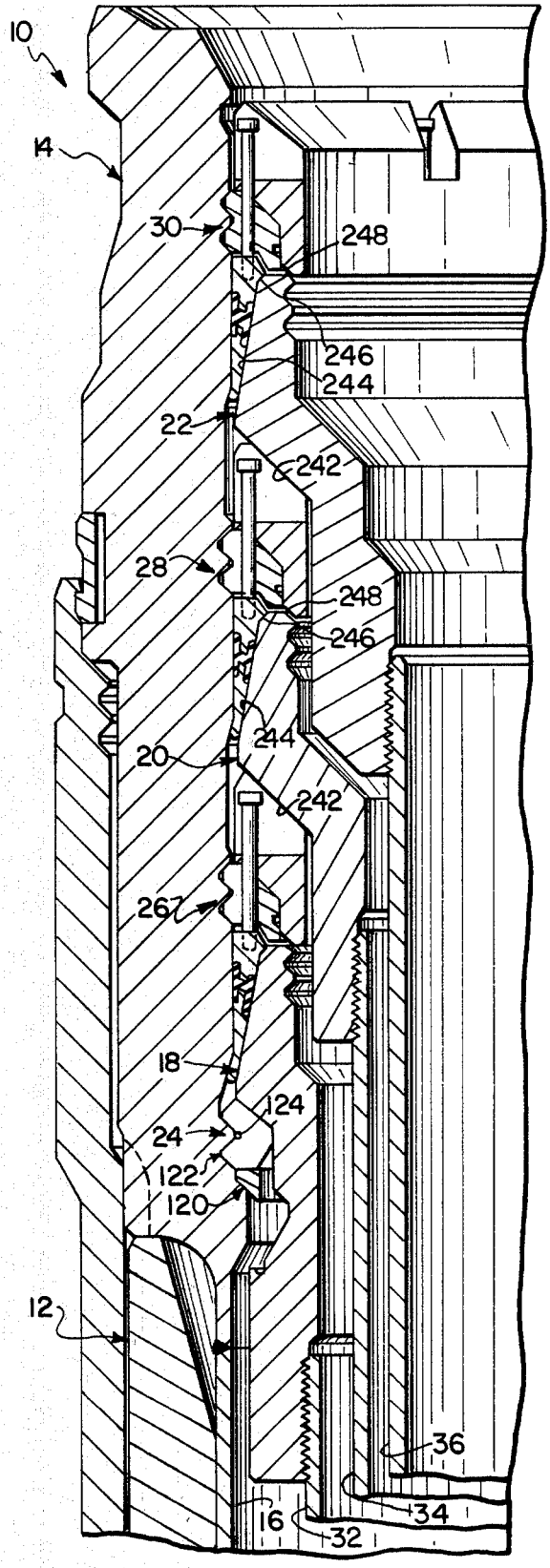
FIG. 1 is a fragmentary vertical sectional view of a wellhead assembly in accordance with one embodiment of the invention.
Figure 7:
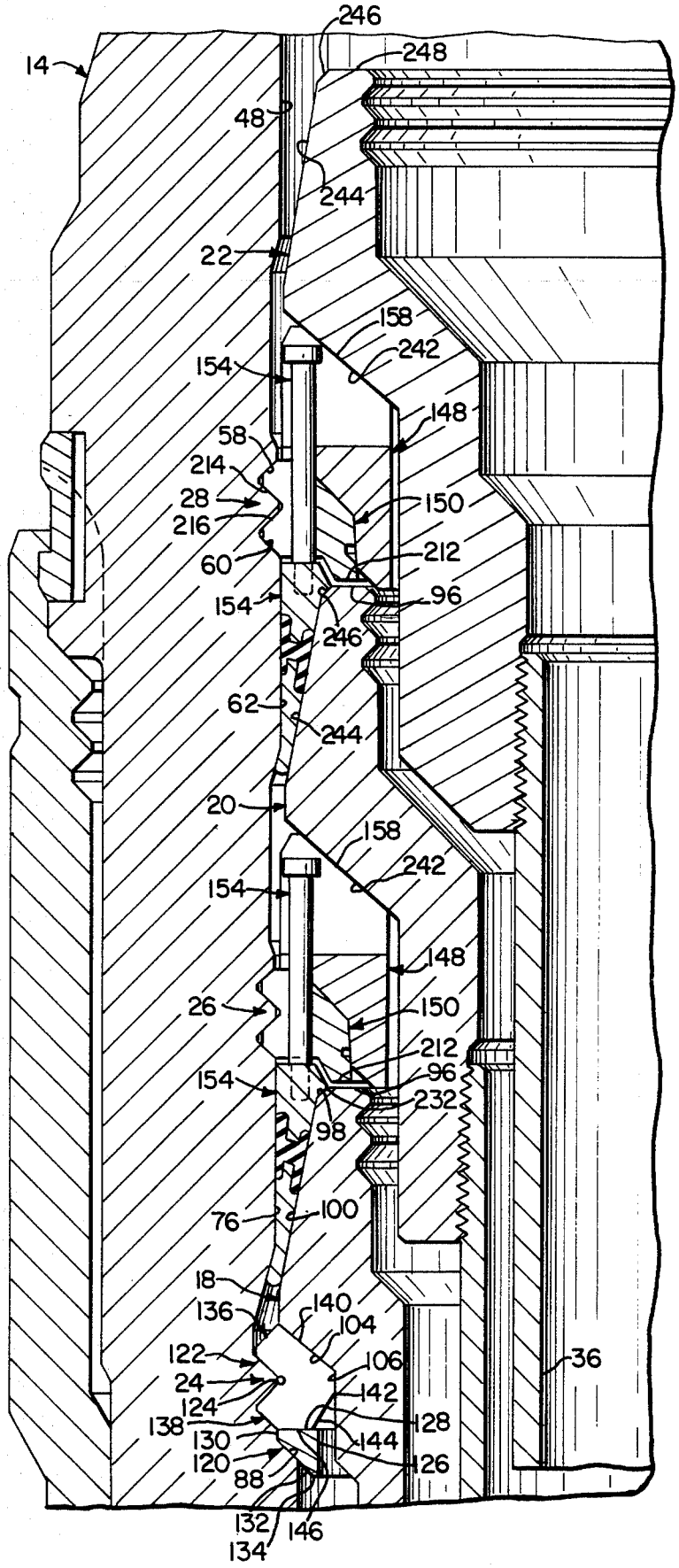
FIG. 7 is an enlarged view similar to FIG. 6 showing a second support and pack-off unit fully landed and in addition a third casing hanger fully landed on the second support and pack-off unit.

As seen in FIG. 1, the well assembly 10 can be part of an underwater well, includes a tubular well member 12, a wellhead lower body 14 supported on the well member, outer casing 16 welded to the bottom of the wellhead lower body, and first, second and third casing hangers 18, 20 and 22 supported in body 14, respectively, by first, second and third annular support devices 24, 26 and 28 with a fourth support device 30 being located above the third casing hanger. Depending respectively from the three casing hangers are three concentric casing strings 32, 34 and 36. As will be described in more detail hereinafter, a plurality of transverse annular grooves are provided in the inner cylindrical surface of the wellhead lower body to receive the annular support devices, all of the grooves having substantially the same inner diameter. None of the adjacent casing hangers are in contact so each of the hangers is independently supported directly by the wellhead lower body, as best seen in FIG. 7. Lower support device 24 can be constructed according to aforementioned U.S. Pat. No. 4,460,042 and is described in detail hereinafter. As will be described in more detail hereinafter, the second, third and fourth support devices are mutually identical, each including a seal or pack-off member for sealing the annulus between the inner surface of body 14 and an upper portion of the respective casing hanger.

Figure 2:
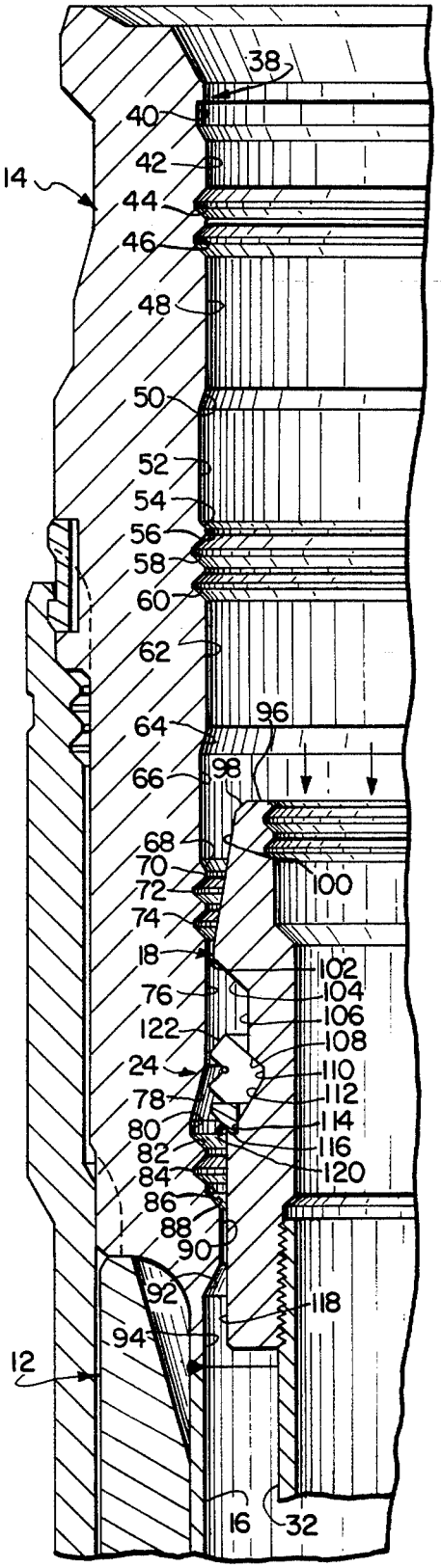
FIG. 2 is a view similar to FIG. 1 showing a first casing hanger being lowered into the wellhead body.

Referring now to FIG. 2, wellhead lower body 14 has a series of grooves, surfaces and a single reduced-radius, upwardly facing shoulder for supporting the respective casing hangers and has as the main upright through bore a substantially right circular cylindrical surface 38. Thus, progressing from the top of the bore of the wellhead lower body to the bottom, there is a handling tool groove 40, a right circular cylindrical surface 42, a pair of annular grooves 44 and 46 defined by walls angled at 45° with the lower wall in each forming an upwardly facing load-bearing shoulder or surface, a right circular cylindrical surface 48, an upwardly and inwardly tapering frustoconical surface 50, an increased diameter right circular cylindrical surface 52, a downwardly and inwardly tapering frustoconical surface 54, a short right circular cylindrical surface 56, a second pair of grooves 58 and 60 similar to grooves 44 and 46, a right circular cylindrical surface 62, an upwardly and inwardly tapering frustoconical surface 64, an increased diameter right circular cylindrical surface 66, a downwardly and inwardly tapering frustoconical surface 68, a short right circular cylindrical surface 70, a third set of grooves 72 and 74 similar to grooves 44 and 46, a right circular cylindrical surface 76, an upwardly and inwardly tapering frustoconical surface 78, a right circular cylindrical surface 80, a downwardly and inwardly tapering frustoconical surface 82 which tapers at 45°, and which is a load-bearing shoulder or surface, an annular groove 84 having walls diverging at 45° with the lower wall forming a load-bearing shoulder, a right circular cylindrical surface 86, a downwardly and inwardly tapering, upwardly facing frustoconical load-bearing shoulder 88, a right circular cylindrical surface 90, an upwardly and inwardly tapering frustoconical surface 92 and a right circular cylindrical surface 94. Surface 88 acts as a lower support means and has a smaller inner diameter than cylindrical surfaces 42, 48, 56, 62, 70 and 76, all of which are of the same diameter. The inner diameters of grooves 44, 46, 58, 60, 72 and 74 are the same.

Casing hanger 18, FIG. 2, is tubular and has a flat upwardly facing, transverse annular upper end surface 96. On the outside, proceeding downwardly from surface 96, are a short upwardly and inwardly tapering frustoconical surface 98, a relatively long upwardly and inwardly tapering frustoconical seal surface 100, a right circular cylindrical surface 102, a downwardly and inwardly tapering frustoconical load-bearing shoulder 104, a right circular cylindrical surface 106, a downwardly and inwardly tapering frustoconical surface 108, a right circular cylindrical surface 110, an upwardly and inwardly tapering frustoconical surface 112, a right circular cylindrical surface 114, an upwardly opening groove 116 and a right circular cylindrical surface 118.

Lower support 24 for supporting the first casing hanger 18 on body 14 comprises, as seen in FIGS. 2, 3, 7 and 8, a lower solid support ring 120, six circularly arranged arcuate support segments 122 and a garter spring 124, FIGS. 7 and 8, for maintaining the segments in an expansible and contractible assembly and biasing the segments radially inwardly. As seen in FIG. 7, the supporting ring 120 has an inner cylindrical surface 126 encircling hanger 18, an upwardly facing transverse annular load-bearing shoulder 128, an outwardly facing right circular cylindrical surface 130, a downwardly and inwardly tapering frustoconical surface 132 which constitutes a load-bearing shoulder, and a downwardly facing transverse annular surface 134 that can be received in groove 116 in the casing hanger, as seen in FIG. 2.

Support segments 122 are mutually identical, each including two outwardly facing ribs 136 and 138 defined by frustoconical walls converging at 45° with the garter spring 124 received between the ribs. On the opposite side of each segment is a downwardly and inwardly tapering frustoconical load-bearing shoulder 140, a right circular cylindrical surface 142, an upwardly and inwardly tapering frustoconical surface 144, and a downwardly facing transverse annular load-bearing surface 146. As seen in FIG. 2, while the first casing hanger 18 is being lowered into the wellhead lower body, the supporting ring 120 is engaged in groove 116 in the casing hanger, surface 126 slidably embraces surface 144, and the support segments 122 rest on ring 120 and are engaged in the groove in the casing hanger defined by surfaces 108, 110 and 112.

Referring now to FIGS. 9–12, the second, third and fourth annular support devices 26, 28 and 30 are mutually identical. Thus, each includes a rigid actuating ring 148, a resilient metal split ring 150 constituting the load-bearing member of the device, a pack-off ring 152 and eight shoulder screws 154 coupling the pack-off member to the actuating ring through split ring 150 in a lost-motion fashion. Actuating ring 148 has a right circular cylindrical inner surface 156, an upper surface formed by a downwardly and inwardly tapering frustoconical load-bearing shoulder 158, a flat upwardly facing transverse annular surface 160 and an upwardly and inwardly tapering frustoconical surface 162, an outer right circular cylindrical surface 164, and a bottom or downwardly facing surface formed by a downwardly facing transverse annular surface 166, a downwardly and inwardly tapering frustoconical camming shoulder 168, an outwardly facing downwardly and inwardly tapering frustoconical surface 170, a downwardly and inwardly facing frustoconical camming surface 172 and a downwardly facing transverse annular surface 174. Ring 148 carries a plurality of circularly spaced radially disposed shear pins 175, FIG. 11, which are spring-biased outwardly and can be constructed according to U.S. Pat. No. 3,268,239, issued Aug. 23, 1966, to E. E. Castor et al. As seen in FIGS. 9 and 11, eight slots 176 are formed in the top of the actuating ring 148 and below each slot is a through bore 178 passing from the bottom of the slot through surfaces 166 and 168 on the ring. These slots and bores accommodate screws 165, the screws having heads 180 and threaded reduced diameter ends 182.

As seen in FIGS. 10 and 11, each ring 150 is split at 184 and has an inner downwardly and inwardly tapering frustoconical surface 186 which tapers at the same small angle as surface 170 and is interrupted by an inwardly facing transverse annular groove 188; an upper surface formed by a downwardly and inwardly tapering frustoconical load-bearing camming surface 190, and upwardly facing transverse annular surface 192, and an upwardly and inwardly tapering frustoconical surface 194; an outer surface defined by a cylindrical surface 196, a downwardly and inwardly tapering frustoconical surface 198, a cylindrical surface 200, an upwardly and inwardly tapering frustoconical surface 202, a cylindrical surface 204, and a downwardly and inwardly tapering frustoconical surface 206; and a bottom surface defined by a downwardly facing transverse annular surface 208, a downwardly and inwardly tapering frustoconical surface 210 and a downwardly facing transverse annular surface 212. As best seen in FIG. 11, surfaces 194, 196 and 198 define a rib 214 with surface 198 constituting a load-bearing shoulder. Surfaces 202, 204 and 206 define a second rib 216 with surface 206 constituting a load-bearing shoulder. Preferably, each of the load-bearing shoulders 198 and 206 tapers at an angle of about 45° to the axis of the ring. Evenly spaced around ring 150 are eight radially outwardly opening slots 218 through which the shoulder screws 154 pass and which allow free relative motion between the screws and ring 150.

The pack-off member 152 is in the form of a solid ring formed of ductile metal with good cold flow, plastic deformation properties. In its undistorted form, ring 152 includes an upwardly facing transverse annular surface 220, an outwardly facing right circular cylindrical surface 222 interrupted by an outwardly facing annular groove 224, a downwardly facing transverse annular surface 226 at the bottom, and on the inside an upwardly and inwardly tapering frustoconical surface 228 interrupted by an inwardly facing annular groove 230, an upwardly and inwardly tapering frustoconical surface 232, which preferably tapers at about 45°, and a downwardly and inwardly tapering frustoconical surface 234. Spaced equally around ring 152 are a series of transverse bores 236 which interconnect grooves 224 and 230, these grooves and bores being filled with elastomeric material 238. As seen in FIG. 11, the portion of the elastomeric material 238 facing radially outwardly does not extend past cylindrical surface 222 while the portion of the material facing radially inwardly extends slightly radially inwardly of surface 228. Formed in top surface 220 are a series of eight threaded blind bores 240 which receive the threaded ends 182 of shoulder screws 154.

Figure 3:
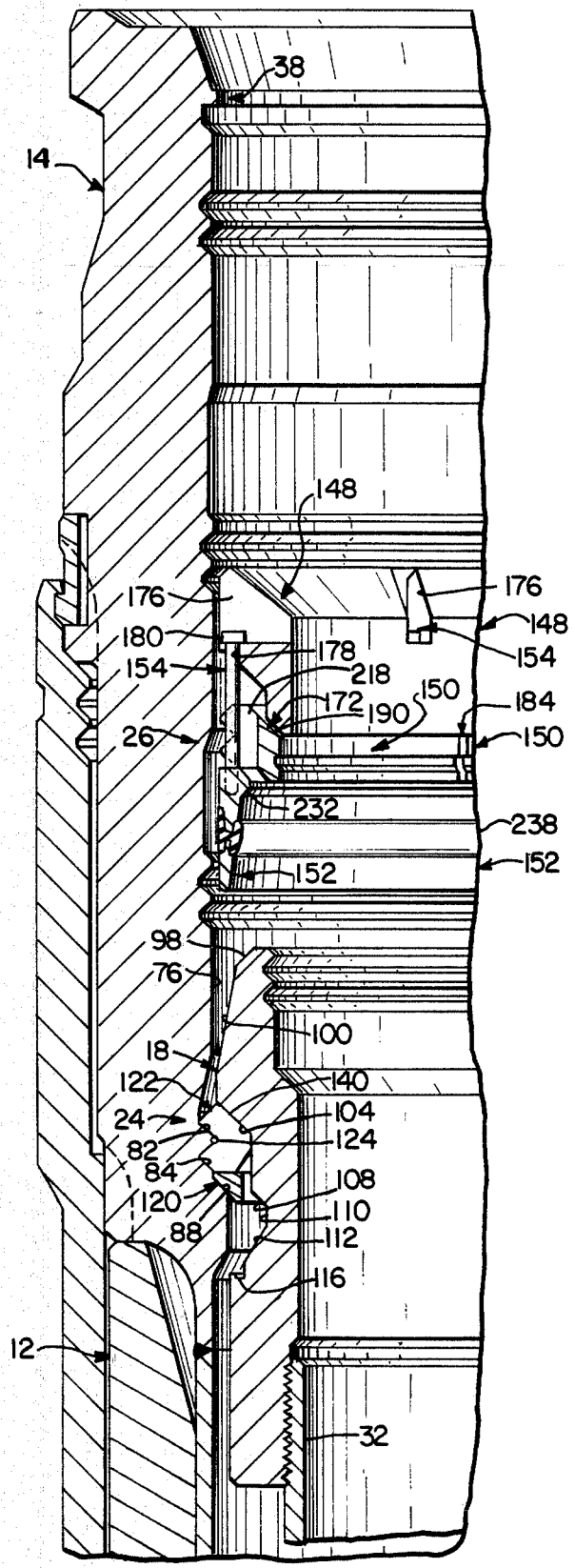
FIG. 3 is a view similar to FIG. 2 showing the first casing hanger fully received in and supported on the wellhead body and a combined support and packoff unit being lowered through the wellhead body toward the first casing hanger.

As seen in FIG. 3, annular support device 26 is so assembled that shoulder screws 154 are received in the actuating ring 148 with their heads 180 at the bottom of the slots 176, with the shanks extending through bores 178 and with the threaded ends 182 engaged in bores 240 in the pack-off ring 152. In addition, with the pack-off ring 152 dangling from actuating ring 148, the split ring 150 is supported with lower rib 216 riding on the upwardly facing end surface 222 of ring 152 and frustoconical surface 190 of the split ring opposing frustoconical surface 172 of actuating ring 148. With the parts thus related, screws 154 pass freely through slots 128 in the split ring.

Referring again to FIG. 1, the second and third casing hangers 20 and 22 are slightly different in detail from the first casing hanger 18 but for purposes of construction and operation of the invention, it is sufficient to note that each is tubular and has on the outer surface a downwardly and inwardly tapering load-bearing frustoconical shoulder 242, and upwardly and inwardly tapering frustoconical seal surface 244, and an upwardly and inwardly tapering frustoconical surface 246. Also, each has an upwardly facing transverse annular upper end face 248. In addition, it is important to note that the upper end face 248 of each hanger is not a load-bearing surface and instead is spaced from the annular support device which is super-adjacent thereto.

Carrying Out the Method with the Apparatus of FIGS. 1–12

Independent suspension of three casing strings to provide well assembly 10, FIG. 1, is accomplished by following the steps illustrated in FIGS. 2–7. The first casing hanger 18, with casing string 32 depending therefrom, is lowered remotely, using a handling string and handling tool (not shown) in conventional fashion, with the hanger passing downwardly through the bore of body 14 until ring 120, which at this time slidably embraces the hanger and occupies the position shown in FIG. 2, engages lower support shoulder 88 on body 14. Further descent of hanger 18 causes the body of the hanger to pass through ring 120 and segments 122 until surfaces 140 of the segments are engaged by shoulder 104 of the hanger. Strain on the handling string is now relaxed, and an increased portion of the weight of the casing string is thus transferred through surfaces 104, 140 to the segments and ring 120. Since further downward movement of ring 120 is now prevented by shoulder 88, the segments are cammed outwardly into full engagement with shoulders 82 and 84, with the segments sliding on upper face 128 of ring 120, so that the full weight of the hanger and its casing string is now supported, via support device 24, on shoulders 82, 84 and 88.

Annular support device 26 is now lowered, using a suitable handling string and tool (not shown) with device 26 descending into body 14 as seen in FIG. 3. Advantageously, the handling tool engages shoulder 158 of the actuating ring and has retractable latch elements engaged below surface 174, so that only the actuating ring of the annular support device is rigidly secured to the handling tool. Accordingly, pack-off ring 152 dangles from the actuating ring via shoulder screws 154, and support ring 150 rests on the pack-off ring. As the annular support device descends, pack-off ring 152 is initially received in the correspondingly tapering annular space between the bore wall of body 14 and frustoconical surface 100 of the casing hanger. At this stage, pack-off ring 152 is lightly wedged between the bore wall and surface 100 with elastomeric material 236 engaging both the bore wall and surface 100. Split ring 150 is in its contracted, inactive position so that ribs 214, 216 are spaced inwardly from grooves 72, 74, ring 150 resting upon the pack-off ring and thus being supported in a position just short of precise alignment with grooves 72, 74.

Figure 4:
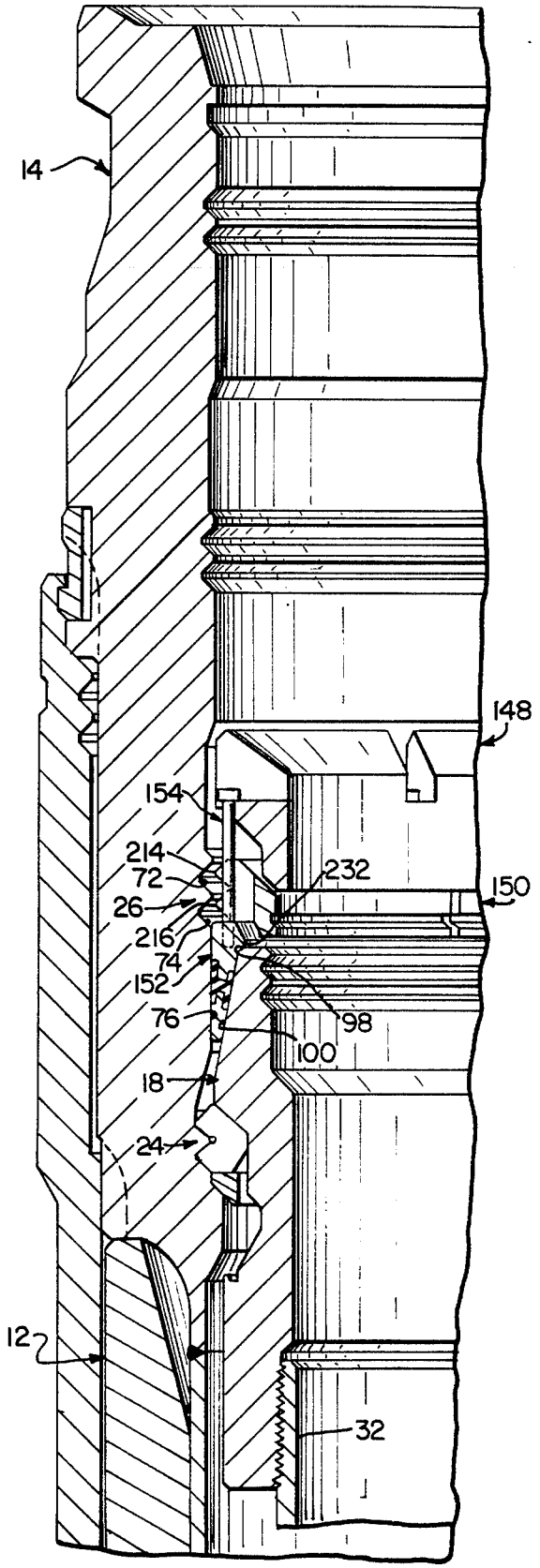
FIG. 4 is a view similar to FIG. 3 showing the pack-off member initially received between the first casing hanger and the wellhead body.

Considering FIGS. 3 and 4, it will be understood that, as annular support device 26 closely approaches that position in which split ring 150 is horizontally aligned with grooves 72 and 74, preliminary wedging engagement of pack-off ring 152 between the hanger and bore wall causes an abrupt increase in resistance to downward travel of the handling string, such an increase occurring because split ring 150 is seated on the pack-off ring and actuating ring 148, to which the handling tool is detachably secured, is in turn seated on the split ring. This increase in resistance to downward travel is readily observable by the operators manipulating the handling string, and so serves to sense the proximity of support device 26 to hanger 18. Since the axial dimensions of the hanger, the space between the lower support and grooves 72, 74, and the axial dimensions of support device 26 are known, sensing of engagement of pack-off ring 152 with hanger 18 also serves to sense the fact that annular support device 26 is just short of being properly aligned with grooves 72, 74.

The handling string is now manipulated to apply a markedly increased downward force on support device 26, with the result that, since further downward travel of pack-off ring 152 is significantly limited because of engagement of surface 208 of the split ring with surface 220 of the pack-off ring, with the pack-off ring now serving as a stop, adequate force is applied by surface 172 of actuating ring 148 to surface 190 of split ring 150 to cam the split ring toward its expanded position until the dependent extension of the actuating ring, defined by surfaces 170, 172, 174 and the lower portion of surface 156, extends telescopically within ring 150, and camming surface 168 approaches engagement with surface 190. Continued application of force downwardly via the handling string and handling tool now causes surfaces 170 and 186 to coact to further expand split ring 150 until the split ring is fully engaged in grooves 72, 74 and surface 168 is seated on surface 190 in the fashion seen in FIG. 5. At this stage, shear pins 175 snap outwardly into grooves 188 to secure the actuating ring against accidental upward displacement.

Though final actuating of support device 26 in the fashion just described accomplished further insertion of the pack-off ring into the space between hanger 18 and the bore wall of the wellhead member, energization of ring 152 into its final metal-to-metal sealing condition has not yet been completed. Energization of the seal ring is now completed by closing the blowout preventers against the handling string and introducing pressure fluid into the wellhead below the blowout preventers, as via the choke and kill lines, to pressurize the wellhead between the handling tool and the blowout preventers to, e.g., 15,000 p.s.i. Since preliminary insertion of ring 152 into the tapered space between surface 100 of hanger 18 and portion 76 of the bore wall causes elastomeric material 238 of ring 152 to engage both surfaces 76 and 100, pressurization of the wellhead forces pack-off ring 152, now acting as a piston, further downwardly to the position seen in FIGS. 5 and 6, with the lower end portion of the seal ring being deformed outwardly under the shoulder constituted by surface 65, FIG. 2, so as to occupy the position seen in FIG. 6. As a result of this further downward movement of ring 152, upper end surface 220 of the seal ring is now spaced a small but significant distance below split ring 150, and since both split ring 150 and actuating ring 148 were stopped short of engagement with hanger 18 when the split ring 150 was forced into engagement in grooves 72 and 74, any downward load now applied to actuating ring 148 will be transfered through split ring 150 directly to the load-bearing shoulders presented by the grooves, none of the load being transferred to either pack-off ring 152 or hanger 18.

Figure 5:
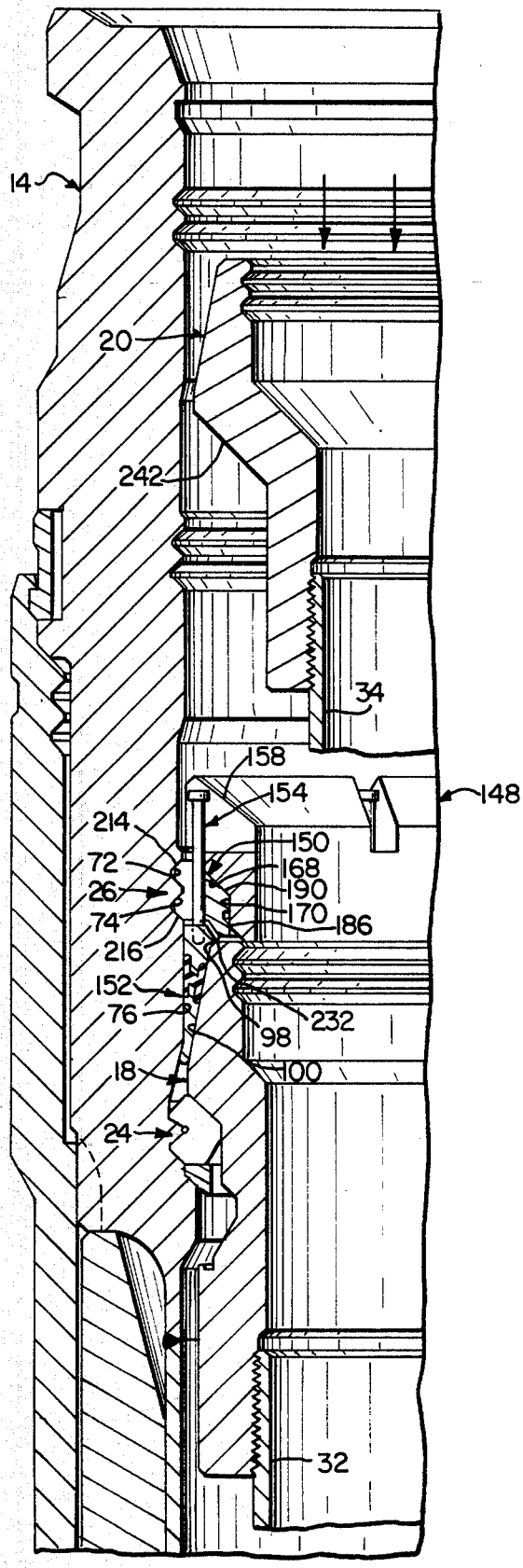
FIG. 5 is a view similar to FIG. 4 showing the pack-off member fully inserted between the wellhead lower body and the first casing hanger, a load-bearing ring of the support and pack-off assembly fully received in grooves in the wellhead body, and a second casing hanger in the process of being lowered into the wellhead lower body.
Figure 6:
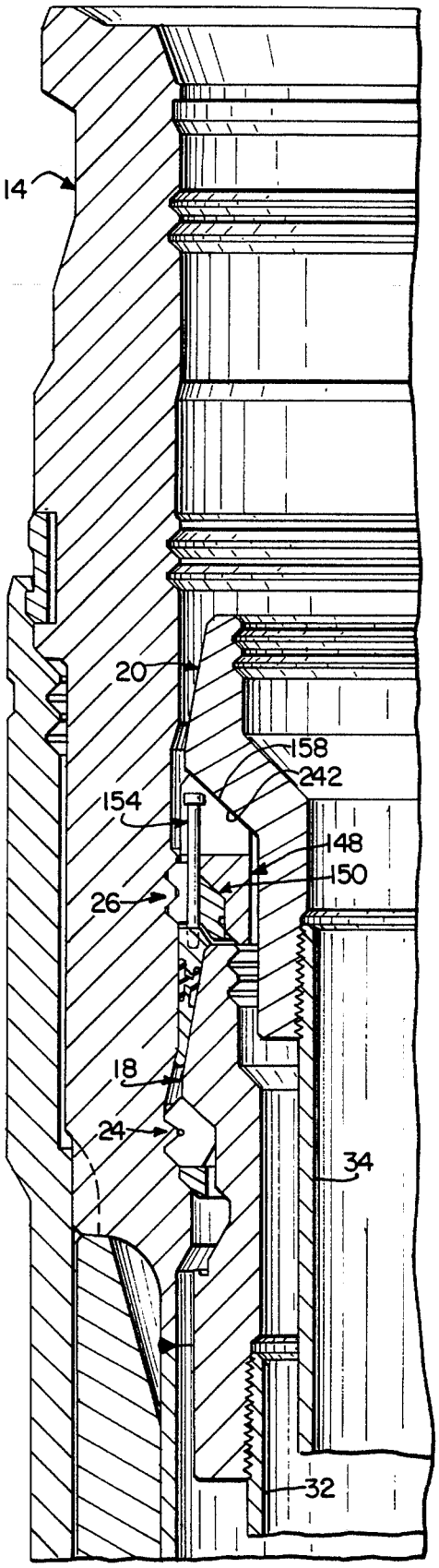
FIG. 6 is a view similar to FIG. 5 showing the second casing hanger fully landed on the support and pack-off assembly.

The next step is illustrated in FIG. 5 with the remote lowering of second casing hanger 20 through the wellhead body. This casing hanger is landed, as seen in FIG. 6, on the actuating ring 148 of second support device 26 with frustoconical surface 158 of the ring engaged by frustoconical surface 242 of the casing hanger. Thus, hanger 20 is supported by support device 26 totally independently of and without regard to the support of casing hanger 18.

The steps illustrated in FIGS. 3–5 and 6 are then sequentially repeated for the second support device 28, the third casing hanger 22 and the fourth support device 30 to result in the configuration shown in FIG. 1. The enlarged fragmentary view shown in FIG. 7 illustrates the well assembly with the first three support devices and the three casing hangers but without the fourth support device 30.

Figure 13:
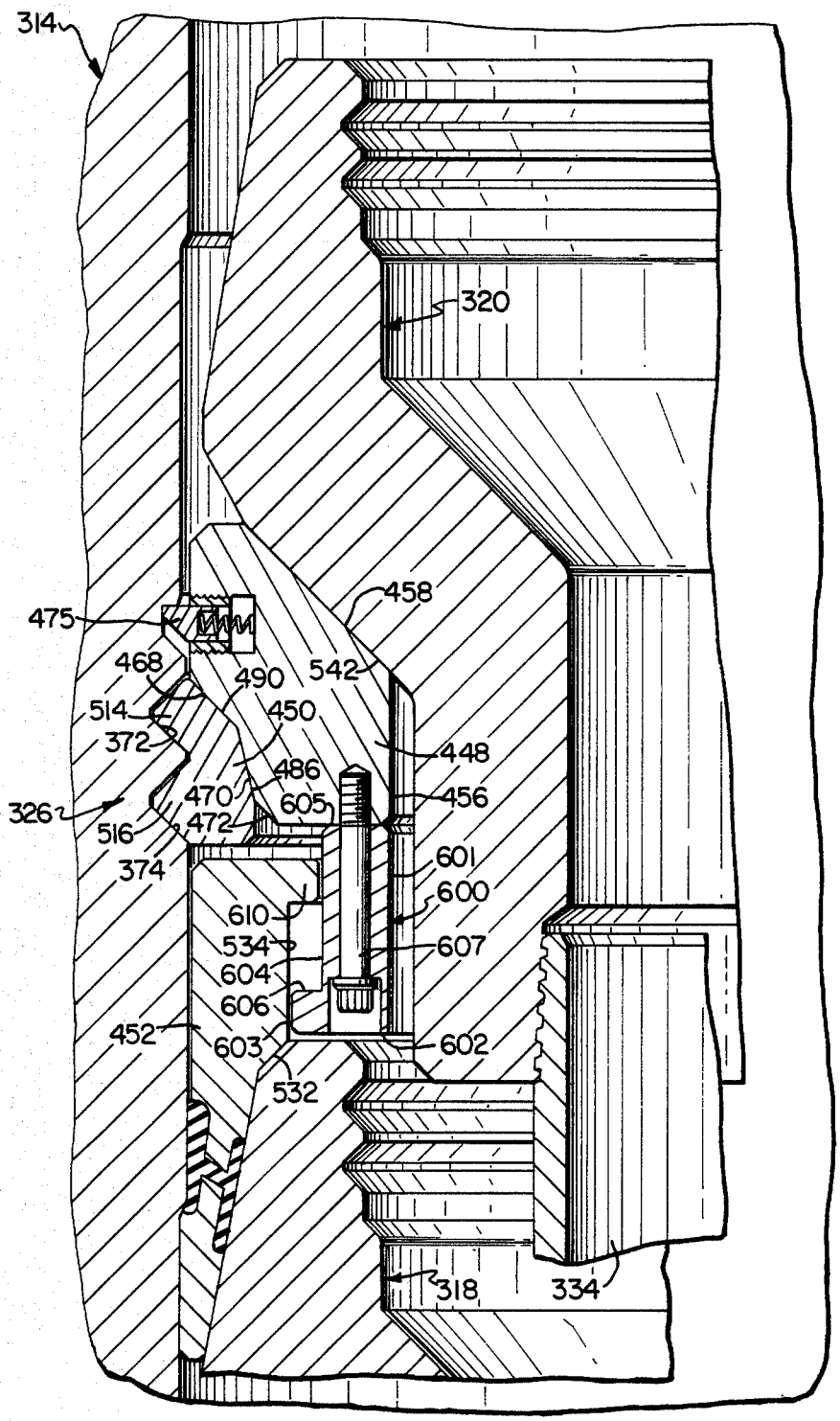
FIG. 13 is a view similar to FIG. 1 illustrating another embodiment of the invention.

The Embodiment of FIG. 13

FIG. 13 illustrates a well assembly according to another embodiment of the invention and including a wellhead body 314, a lower casing hanger 318, an upper casing hanger 320, and an annular support device 326 which supports hanger 318, and its casing string 334, independently of hanger 320. Hanger 318 is supported on a lower support (not shown) in any suitable fashion.

Support device 326 comprises a solid actuating ring 438, a resilient metal split support ring 450 and a pack-off ring 452. Ring 448 is generally similar to ring 148, FIG. 11, and has a frustoconical, downwardly and inwardly tapering, upwardly directed camming surface 458, upon which shoulder 542 of hanger 320 seats in flush engagement, and frustoconical, downwardly and inwardly tapering, downwardly directed camming surfaces 468, 470 and 472. Support ring 450 is generally similar to ring 150, FIG. 11, but has no slots corresponding to slots 218 of ring 150. Support ring 450 thus includes frustoconical, downwardly and inwardly tapering, upwardly directed camming surfaces 490 and 486, the latter being a continuous, ungrooved surface. The support ring also includes outwardly projecting ribs 514 and 516 corresponding in shape to transverse annular inwardly opening grooves 372 and 374 in the bore wall of body member 314.

In this embodiment, the lost motion connection between actuating ring 448 and pack-off ring 452 is established by securing to the actuating ring a dependent tubular retaining member 600 having a right circular cylindrical inner surface 601, of the same diameter as inner surface 456 of actuating ring 448, a flat transverse annular lower end surface 602, an outer surface composed of a lower right circular cylindrical portion 603 and an upper elongated right circular cylindrical portion 604 which is of substantially smaller diameter than portion 603, and a flat transverse annular upper end surface 605. Outer surface portions 603 and 604 are joined by an upwardly directed shoulder 606. Member 600 is rigidly secured to ring 448, as by screws 607, with surfaces 456 and 601 coaxial and with shoulder 606 spaced below the lower end surface 474 of the actuating ring by a predetermined distance.

Pack-off ring 452 is generally similar to ring 152, FIG. 11, save that the portion of the metal ring above shoulder 532 includes a right circular cylindrical inner surface portion 534, of a diameter only slightly larger than that of surface portion 603 of member 600, and a transverse annular inwardly projecting support flange 610 which has an inner diameter only slightly larger than the diameter of surface portion 604 of member 600. Before being secured to actuating ring 448, member 600 is inserted within the space defined by surface portion 534 and flange 610 of the pack-off ring, so that shoulder 606 opposes flange 610, as shown. Thus, before annular support device 326 is installed as seen in FIG. 13, pack-off ring 452 is retained by engagement of flange 610 with shoulder 606, and support ring 450 is retained by engagement with the pack-off ring, but both the pack-off ring and the support ring are free to move, relative to the actuating ring, to the positions seen in FIG. 13. Thus, the combination of actuating ring 448, support ring 450 and pack-off ring 452 can be lowered by a handling tool (not shown), the handling tool being releasably attached to the actuating ring by latch elements engaged beneath lower end surface 602 of member 600. With device 326 thus supported by a handling tool and handling string, pack-off ring 452 dangles from actuating ring 448 in the same general fashion as hereinbefore described for the embodiment of FIGS. 1-12, and it will be apparent that the method can be carried out with the embodiment of FIG. 13 in the same fashion as hereinbefore described with reference to FIGS. 1-12.

In this embodiment, shear pins 475 are again provided to releasably secure the actuating ring against displacement, once support ring 450 has been cammed outwardly to its expanded position and thus engaged in grooves 372, 374. However, rather than acting between the actuating ring and the support ring, shear pins 475 are located in an upper portion of the actuating ring and snap directly into a transverse annular inwardly opening groove 488 in the bore wall of body member 314 once the support ring has been expanded into grooves 372, 374.

It is to be noted that the relative dimensions of actuating ring 448, support ring 450, member 600 and pack-off ring 452, and the location of grooves 372, 374 relative to the lower support on which lower hanger 318 is supported, are such that, when support device 326 has been lowered until the pack-off ring seats preliminarily in the annular space between hanger 318 and the bore wall, support ring 450 has then been cammed outwardly into grooves 372, 374, and pack-off ring 452 has then been fully energized, to the position seen in FIG. 13, as by application of hydraulic pressure in the manner hereinbefore described, there is significant space between the upper end face of the pack-off ring and the lower end face of the support ring, as well as significant space between the upper end face of hanger 318 and the lower end face of member 600, so that none of the downward load applied to ring 448 by upper hanger 320 can be transferred to lower hanger 318. Thus, all of the weight of casing string 334 is transferred through rings 448 and 450 to the lower walls of grooves 372, 374 and the support of the load applied to support ring 450 by hanger 320 and its pipe string 334 is completely independent of the support for hanger 318.

Though particularly advantageous embodiments of the invention have been chosen for illustrative purposes, it will be understood that various changes and modifications can be made therein without departing from the scope of the invention as defined by the appended claims. Thus, any suitable lower support can be used in place of support 24, and other annular seal devices can be used in place of pack-off ring 152 or pack-off ring 452, so long as the pack-off ring employed can be energized by downwardly acting force.

What is claimed is:

1. In a remotely installed underwater well installation capable of operating under conditions of high internal fluid pressure and of supporting long and heavy strings of well pipe, the combination of a support member having an elongated upright through bore, a generally upwardly facing lower support, and a transverse annular inwardly opening groove in a portion of the wall of the through bore which is of substantially uniform diameter, the groove being located above the lower support and having a lower wall constituting a load-bearing shoulder;

first hanger means seated on the lower support of the support member and having a first string of pipe depending therefrom, the load applied by the first hanger means under the weight of the first string of pipe being applied directly to the support member via the upwardly facing lower support;

second hanger means from which a second string of pipe depends, the second hanger means comprising an annular load-bearing member having a first lower surface portion, a second lower surface portion disposed inwardly of the first lower surface portion and constituting a stop surface, and an upwardly directed downwardly and inwardly tapering camming surface, the annular load-bearing member being resiliently deformable between a first condition, in which the load-bearing member is relaxed and has an outer diameter sufficiently small to allow the load-bearing member to be passed through the through bore of the support member, and a second condition, in which the load-bearing member is expanded to present an outer diameter substantially larger than the inner diameter of the load-bearing shoulder of the groove, the load-bearing member being in its second condition and engaged in the groove with the first lower surface portion of the load-bearing member in flush engagement with the load-bearing shoulder of the groove, and a camming member to which the weight of the second string of pipe is applied downwardly and which includes a downwardly and inwardly tapering camming surface engaged with the camming surface of the load-bearing member to maintain the load-bearing member engaged in the groove; and upwardly projecting stop means which, at the time of lowering the second hanger means into the through bore of the support member, is located below the groove in a position to be engaged by the second lower surface portion of the annular load-bearing member to stop the annular load-bearing member so that downward movement of the camming member of the second hanger means cams the load-bearing member to its second condition;

the load applied by the second hanger means under the weight of the second string of pipe being applied directly to the support member via the lower wall of the groove.

2. The combination defined in claim 1, wherein the upwardly projecting stop means comprises an annular seal member which occupies said position when initially installed, and is thereby present as a stop member to be engaged by the second lower surface portion of the load-bearing member, but which in its finally actuated position is spaced below the load-bearing member.

3. The combination defined in claim 2, wherein the seal member is an annular pack-off device engaged in sealing relation between an upper portion of the first hanger means and the surrounding portion of the wall of the through bore of the support member, the annular pack-off device being connected to the second hanger means.

4. The combination defined in claim 3, wherein the annular pack-off device depends from the second hanger means via a lost-motion connection, whereby the combination of the second hanger means and the pack-off device can be installed as a unit, the pack-off device can then serve as the stop to be engaged by the second lower surface portion of the annular load-bearing member, and the pack-off device can then be energized independently of the second hanger means.

5. The combination defined in claim 4, wherein the second hanger means comprises an actuating ring operatively associated with the annular load-bearing member of the second hanger means and capable of being moved downwardly relative thereto to force the load-bearing member outwardly into engagement with the groove; and the lost-motion connection is between the pack-off device and the actuating ring.

6. The combination defined in claim 5, wherein the annular load-bearing member of the second hanger means has a plurality of openings; and the lost-motion connection comprises elements depending from the actuating ring and extending through the openings in the load-bearing member.

7. The combination defined in claim 2, wherein the wall of the through bore of the support member has a downwardly directed transverse annular shoulder spaced below the groove; and the annular seal member is a metal pack-off ring engaged between an outer portion of the first hanger means and the wall of the through bore of the support member and deformed under said downwardly directed shoulder.

8. In a remotely installed underwater well installation capable of operating under conditions of high internal fluid pressure and of supporting long and heavy strings of well pipe, the combination of a support member having an elongated upright through bore, a generally upwardly facing lower support, and a transverse annular inwardly opening groove in a portion of the wall of the through bore which is of substantially uniform diameter, the groove being located above the lower support and having a lower wall constituting a load-bearing shoulder;

a first pipe hanger seated on the lower support and having a string of pipe depending therefrom, the load applied by the first pipe hanger under the weight of the string of pipe being applied directly to the support member via the upwardly facing lower support;

an annular support device comprising an annular load-bearing member having a first lower surface, a second lower surface disposed inwardly of the first lower surface, and an upwardly directed downwardly and inwardly tapering camming surface, the annular load-bearing member being resiliently deformable between a first condition, in which the load-bearing member is relaxed and presents an outer diameter sufficiently small to allow the load-bearing member to be passed through the through bore of the support member, and a second condition, in which the load-bearing member is expanded to present an outer diameter substantially larger than the inner diameter of the load-bearing shoulder presented by the groove, the load-bearing member being in its second condition and engaged in the groove with the first lower surface of the load-bearing member in flush engagement with the load-bearing shoulder presented by the groove and the second lower surface downwardly exposed within the through bore of the support member, the annular support device further comprising an actuating ring disposed above the load-bearing member and having an upper surface and a frustonical lower surface, the lower surface tapering downwardly and inwardly at the same angle as the camming surface of the load-bearing member and being in contact therewith; and a second pipe hanger seated on the upper surface of the actuating ring and having a string of pipe depending therefrom concentrically within the string of pipe supported by the first pipe hanger;

the load applied by the second pipe hanger under the weight of the string of pipe depending therefrom acting on the camming surface of the annular load-bearing member to bias the annular load-bearing member outwardly to maintain the load-bearing member engaged in the groove and being applied directly to the support member via contact between the first lower surface of the load-bearing member and the load-bearing shoulder presented by the groove, whereby the load imparted via the second pipe hanger is applied to the support member independently of the load imparted to the support member via the first pipe hanger.

9. The combination defined in claim 8, wherein the annular load-bearing member of the support device is a resilient metal split ring having a relaxed and undistorted outer diameter smaller than the diameter of the through bore of the support member.

10. In a remotely installed underwater well installation capable of operating under conditions of high internal fluid pressure and of supporting long and heavy strings of well pipe, the combination of a support member having an elongated upright through bore, a generally upwardly facing lower support, and a transverse annular inwardly opening groove in a portion of the wall of the through bore which is of substantially uniform diameter, the groove being located above the lower support and having a lower wall constituting a load-bearing shoulder;

a first pipe hanger seated on the lower support and having a string of pipe depending therefrom, the load applied by the first pipe hanger under the weight of the string of pipe being applied directly to the support member via the upwardly facing lower support;

an annular support device comprising an annular load-bearing member having a first lower surface portion, a second lower surface portion disposed inwardly of the first lower surface portion, and an upwardly directed downwardly and inwardly tapering camming surface, the annular load-bearing member being resiliently deformable between a first condition, in which the load-bearing member is relaxed and presents an outer diameter sufficiently small to aloow the load-bearing member to be passed through the through bore of the support member, and a second condition, in which the load-bearing member is expanded to present an outer diameter substantially larger than the inner diameter of the load-bearing shoulder presented by the groove, the load-bearing member being in its second condition and engaged in the groove with the first lower surface portion of the load-bearing member in flush engagement with the load-bearing shoulder presented by the groove and the second lower surface portion downwardly exposed within the through bore of the support member;

a second pipe hanger supported by the annular support device and having a string of pipe depending therefrom concentrically within the string of pipe supported by the first pipe hanger, the second pipe hanger having a generally downwardly directed load-bearing surface via which load is transferred from the second pipe hanger to the annular support device; the load applied by the second pipe hanger under the weight of the string of pipe depending therefrom acting on the camming surface of the annular load-bearing member to bias the load-bearing member outwardly to maintain the load-bearing member engaged in the groove and being applied directly to the support member via contact between the first lower surface portion of the load-bearing member and the load-bearing shoulder presented by the groove, whereby the load imparted via the second pipe hanger is applied to the support member independently of the load imparted to the support member via the first pipe hanger;

the support member having a second transverse annular inwardly opening groove in said portion of the wall of the through bore and spaced above the first-mentioned groove;

the combination further comprising a second annular support device including a second annular load-bearing member engaged in the second groove, the second annular support device being substantially identical to the first-mentioned annular support device; and a third pipe hanger supported by the second annular support device and having a string of pipe depending therefrom and within the string of pipe depending from the second pipe hanger.

11. In a combined pipe hanger support and pack-off assembly capable of being installed remotely as a unit for packing off between a first pipe hanger and the bore wall of a support member such as a wellhead member and also supporting a super-adjacent second pipe hanger, the combination of an annular load-bearing device which is resiliently expansible and conrtractible between a relaxed and inactive condition of smaller diameter and an expanded and active condition of larger diameter, the load-bearing device having an outer periphery of such shape and dimensions as to be engageable in an inwardly opening transverse annular groove in the bore wall of the support member, said outer periphery including a downwardly directed shoulder capable of flush engagement with the bottom wall of the groove, and an upwardly directed camming surface which is exposed within the bore of the support member when the load-bearing device is engaged in the groove;

an annular pack-off device disposed below the load-bearing device;

an annular actuating device disposed above the load-bearing device and having a downwardly directed camming surface, and an upwardly directed support shoulder; and a lost-motion support interconnecting the pack-off device and the actuating device so that, when the actuating device is supported by a handling tool, the pack-off device depends from the actuating device via the lost-motion support and the axial space between the pack-off device and the actuating device is sufficiently large to allow the annular load-bearing device to remain in its relaxed and inactive condition, downward movement of the actuating device, after the pack-off device has been landed, being effective to cause the downwardly directed camming surface of the actuating device to coact with the upwardly directed camming surface of the annular load-bearing device to expand the load-bearing device to its active condition.

12. The combination defined in claim 11, wherein the annular load-bearing device is a resilient metal split ring.

13. The method for installing a plurality of concentric well pipes in an underwater well by remote operations so that the pipes are supported independently from a single support member, comprising the steps of installing in an underwater location a support member having an upright through bore, a generally upwardly facing lower support, and a transverse annular inwardly opening groove in a portion of the wall of the through bore which is of substantially uniform diameter, the groove being located above the lower support and having a lower wall constituting a load-bearing shoulder;

lowering a first pipe hanger and a string of pipe depending therefrom into the through bore of the support member until the first pipe hanger is supported directly by the lower support;

lowering into the through bore an annular support device comprising an annular load-bearing member which is resiliently expansible and contractible between a relaxed position of smaller diameter and an expanded position of larger diameter, the load-bearing member occupying its relaxed position while the annular support device is lowered, and an upwardly directed frustoconical camming surface which tapers downwardly and inwardly, whereby a downwardly acting force applied to the camming surface will be effective to force the load-bearing member to its expanded position;

stopping the annular support device with the annular load-bearing member aligned generally with the groove of the support member; applying a downwardly acting force to the camming surface of the annular support device and thereby forcing the load-bearing member to its expanded position, whereby the load-bearing member is engaged in the groove of the support member; and while maintaining the load-bearing member of the annular support device in its expanded position and engaged in the groove of the support member, lowering a second pipe hanger and a string of pipe depending therefrom into the through bore of the support member until the second pipe hanger is supported on the annular support device and the total load of the second pipe hanger and its depending string of pipe is transferred to the support member via the annular support device independently of support of the first pipe hanger and its depending string of pipe.

14. The method defined in claim 13, wherein a pack-off device for the first pipe hanger is lowered concurrently with the annular support device until the pack-off device is preliminarily engaged with the first pipe hanger; and the step of stopping the annular support device is accomplished by engaging the annular support device with the preliminarily engaged pack-off device;

the method further comprising applying a downwardly acting force to the pack-off device to force the pack-off device into full engagement with the first pipe hanger and eliminate any load-bearing contact between the pack-off device and the annular support device.

* * * * *